US011098552B2

(12) United States Patent
Alharbi

(10) Patent No.: US 11,098,552 B2
(45) Date of Patent: Aug. 24, 2021

(54) SYSTEMS AND METHODS FOR FREEING STUCK PIPE

(71) Applicant: Saudi Arabian Oil Company, Dhahran (SA)

(72) Inventor: Atallah Alharbi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 58 days.

(21) Appl. No.: 16/410,723

(22) Filed: May 13, 2019

(65) Prior Publication Data

US 2020/0362658 A1 Nov. 19, 2020

(51) Int. Cl.

| | |
|---|---|
| ***E21B 33/068*** | (2006.01) |
| ***E21B 31/03*** | (2006.01) |
| ***E21B 34/06*** | (2006.01) |

(52) U.S. Cl.

CPC ..... *E21B 33/068* (2013.01); *E21B 31/03* (2013.01); *E21B 34/06* (2013.01)

(58) Field of Classification Search

CPC ..... E21B 31/00; E21B 33/068

See application file for complete search history.

(56) References Cited

U.S. PATENT DOCUMENTS

| | | | |
|---|---|---|---|
| 2,808,887 | A | 10/1957 | Erwin |
| 3,104,707 | A | 9/1963 | Overly |
| 3,246,696 | A | 4/1966 | Fox |
| 4,986,361 | A | 1/1991 | Mueller et al. |
| 5,181,571 | A | 1/1993 | Mueller et al. |
| 5,456,317 | A | 10/1995 | Hood et al. |
| 5,829,526 | A | 11/1998 | Rogers et al. |
| 6,443,244 | B1 | 9/2002 | Collins |
| 6,505,685 | B1 | 1/2003 | Sullaway et al. |
| 6,634,430 | B2 | 10/2003 | Dawson et al. |
| 7,163,059 | B2 | 1/2007 | Elder |
| 7,549,479 | B2 | 6/2009 | Biegler et al. |
| 7,677,322 | B2 | 3/2010 | Jordan et al. |
| 10,208,564 | B2 | 2/2019 | Ravensbergen et al. |
| 2016/0084013 | A1 | 3/2016 | Hradecky |
| 2018/0320464 | A1 | 11/2018 | Heitmann |

FOREIGN PATENT DOCUMENTS

| | | | |
|---|---|---|---|
| CN | 104005708 | B | 6/2016 |
| WO | 2018136451 | A1 | 7/2018 |

OTHER PUBLICATIONS

International Search Report and Written Opinion of PCT Application No. PCT/US2020/032545 dated Jul. 31, 2020, 16 pages.

*Primary Examiner* — Robert E Fuller

(74) *Attorney, Agent, or Firm* — Bracewell LLP; Constance G. Rhebergen; Linda L Morgan

(57) ABSTRACT

Systems and methods for unsticking a tubular string in a subterranean well that is a stuck pipe include securing a circulation sub to an uphole end of the tubular string outside of the subterranean well. The buoyancy of the tubular string is increased by delivering a replacement fluid through the circulation sub and into a bore of the tubular string. The replacement fluid displaces an operating fluid located within the bore of the tubular string. A density of the replacement fluid is less than a density of the operating fluid. Conventional operations for unsticking the tubular string can be performed. The replacement fluid in the bore of the tubular string can be replaced with the operating fluid, and the replacement fluid can be delivered back out of the subterranean well.

19 Claims, 4 Drawing Sheets

SYSTEMS AND METHODS FOR FREEING STUCK PIPE

BACKGROUND OF THE DISCLOSURE

1. Field of the Disclosure

The disclosure relates generally to hydrocarbon development operations in a subterranean well, and more particularly to moving tubular members within a subterranean well during hydrocarbon development operations.

2. Description of the Related Art

A stuck pipe within a subterranean well is a cause of lost time during drilling and completion operations, especially in deviated and horizontal wells. A stuck pipe occurs when the pipe cannot be moved up or down or rotated within the wellbore. The stuck pipe can be a tubular string such as, for example, a drill string, a casing string, or another elongated member that is lowered into the subterranean well. A stuck pipe can have a variety of causes, including mechanical sticking such as well packing off, wellbore geometry, or bridging, or can be caused by differential sticking.

Problems resulting from a stuck pipe can range from incidents causing an increase in costs, to incidents where it takes days to get the pipe unstuck or incidents that require expensive remedial action to complete the well. In extreme cases where the problem cannot be resolved, the bore may have to be plugged and abandoned.

SUMMARY OF THE DISCLOSURE

Systems and methods of this disclosure increase the buoyancy of the stuck pipe, improving the probability of unsticking the stuck pipe. Operating fluids within the stuck pipe are replaced with a replacement fluid that has a density that is less than the density of the operating fluid. Increasing the buoyancy of the stuck pipe will increase the upward force acting on the stuck pipe and can reduce friction forces acting on the stuck pipe. In addition to increasing the buoyancy of the stuck pipe, the static stresses and bending moments of the stuck pipe will be altered, which can assist in overcoming the forces or mechanical issues that are causing the pipe to stick.

Embodiments of this disclosure provide a check valve located within the bore of the stuck pipe. The check valve allows for the operating fluid to exit the bore of the stuck pipe as replacement fluid is pumped into the stuck pipe. A circulation sub can be secured to an upper end of the stuck pipe outside of the subterranean well. The circulation sub can manage and direct the replacement fluid that is pumped into the stuck pipe. The circulation sub can also manage and direct the return of the operating fluid to the bore of the stuck pipe during the venting of the replacement fluid out of the stuck pipe.

Systems and methods of this disclosure can be used with currently available methods of unsticking a stuck pipe and can increase the success rate of such currently available methods.

In an embodiment of this disclosure a method for unsticking a tubular string in a subterranean well that is a stuck pipe includes securing a circulation sub to an uphole end of the tubular string outside of the subterranean well. A buoyancy of the tubular string is increased by delivering a replacement fluid through the circulation sub and into a bore of the tubular string, the replacement fluid displacing an operating fluid located within the bore of the tubular string. A density of the replacement fluid is less than a density of the operating fluid. Operations for unsticking the tubular string can be performed. The replacement fluid in the bore of the tubular string can be displaced with the operating fluid, and delivering the replacement fluid out of the subterranean well.

In alternate embodiments, delivering the replacement fluid through the circulation sub and into the bore of the tubular string can cause the operating fluid to pass through a check valve and exit the bore of the tubular string at a location downhole of the circulation sub. An injection pressure of the replacement fluid can be managed so that the level of replacement fluid within the bore of the tubular string is controlled and the replacement fluid is prevented from passing through the check valve. The operating fluid can exit the tubular string at a downhole end of the tubular string. The operating fluid can be a drilling mud and the replacement fluid can be a gas.

In other alternate embodiments, the circulation sub can be a two-phase circulation sub that can include an operating fluid delivery assembly. The operating fluid delivery assembly can include a conical bore with a frusto conical inner surface. Displacing the replacement fluid in the bore of the tubular string with the operating fluid can include delivering the operating fluid to the frusto conical inner surface so that the frusto conical inner surface directs the operating fluid into the bore of the tubular string along an inner wall of the bore of the tubular string in a rotational direction, the operating fluid defining a return vent along a central axis of the bore of the tubular string, the return vent being free of operating fluid.

In yet other alternate embodiments, the circulation sub can further include a venting assembly. The venting assembly can have a fluid flow path in fluid communication with the return vent. The replacement fluid can be delivered out of the subterranean well through the circulation sub by venting the replacement fluid through the venting assembly. The circulation sub can alternately include a replacement fluid delivery assembly having a source of compressed replacement fluid. Delivering the replacement fluid through the circulation sub can include delivering the replacement fluid from the source of compressed replacement fluid.

In other embodiments, a plug can be located within the bore of the tubular string downhole of the circulation sub. The plug can prevent a flow of fluid through the bore of the tubular string past the plug. The circulation sub can include a first swivel at a first end of the circulation sub, a second swivel at a second end of the circulation sub, and a ported tubular member extending between the first swivel and the second swivel. Performing operations for unsticking the tubular string can include rotating the tubular string.

In an alternate embodiment of this disclosure, a method for unsticking a tubular string in a subterranean well that is a stuck pipe includes securing a circulation sub to an uphole end of the tubular string outside of the subterranean well. The buoyancy of the tubular string is increased. A replacement fluid is delivered through the circulation sub and into a bore of the tubular string. The replacement fluid displaces an operating fluid located within the bore of the tubular string so that the operating fluid passes through a check valve and exits the bore of the tubular string at a location downhole of the circulation sub. A portion of the operating fluid travels out of the subterranean well through an annulus defined between an outer surface of the tubular string and an inner surface of a wellbore of the subterranean well. A density of the replacement fluid is less than a density of the operating fluid. Operations for unsticking the tubular string can be performed. The replacement fluid in the bore of the tubular string is displaced with the operating fluid. The operating fluid is delivered through the circulation sub and into the bore of the tubular string as a rotational flow along an inner wall of the bore of the tubular string the operating fluid defining a return vent along a central axis of the bore of the tubular string, the return vent being free of operating fluid. The replacement fluid is delivered out of the subterranean well through the return vent and the circulation sub.

In alternate embodiments, an injection pressure of the replacement fluid can be managed so that the replacement fluid is prevented from passing through the check valve. The circulation sub can include an operating fluid delivery assembly. The operating fluid delivery assembly can cause the rotational flow of the operating fluid with a conical bore with a frusto conical inner surface, a motor that rotates a portion of the circulation sub, rotating impellers, stationary vanes, and combinations thereof. The circulation sub can include a first swivel at a first end of the circulation sub, a second swivel at a second end of the circulation sub, and a ported tubular member extending between the first swivel and the second swivel. Performing operations for unsticking the tubular string can include rotating the tubular string.

In another alternate embodiment of this disclosure, a system for unsticking a tubular string in a subterranean well that is a stuck pipe includes a circulation sub secured to an uphole end of the tubular string outside of the subterranean well. A check valve is located within a bore of the tubular string downhole of circulation sub. An annulus is defined between an outer surface of the tubular string and an inner surface of a wellbore of the subterranean well. The circulation sub is operable to deliver a replacement fluid into the bore of the tubular string so that an operating fluid exits the bore of the tubular string through the check valve. The circulation sub is further operable to deliver operating fluid into the bore of the tubular string as the replacement fluid is delivered out of the subterranean well. A density of the replacement fluid is less than a density of the operating fluid.

In alternate embodiments, an exit port can be located at a downhole end of the tubular string, the exit port providing fluid communication between the bore of the tubular string and the annulus. The operating fluid can be a drilling mud and the replacement fluid can be a gas.

In other alternate embodiments, the circulation sub can include an operating fluid delivery assembly. The operating fluid delivery assembly can include a conical bore with a frusto conical inner surface shaped to direct the operating fluid into the bore of the tubular string along the inner wall of the bore of the tubular string so that the operating fluid is delivered into the bore of the tubular string as a rotational flow along an inner wall of the bore of the tubular string, the operating fluid defining a return vent along a central axis of the bore of the tubular string, the return vent being free of operating fluid so that the replacement fluid is delivered out of the subterranean well through the return vent and the circulation sub. The circulation sub can further include a venting assembly. The venting assembly can have a fluid flow path in fluid communication with the return vent.

In yet other alternate embodiments, the circulation sub can include a replacement fluid delivery assembly having a source of compressed replacement fluid. The circulation sub can include a first swivel at a first end of the circulation sub, a second swivel at a second end of the circulation sub, and a ported tubular member extending between the first swivel and the second swivel.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION OF THE DISCLOSURE

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
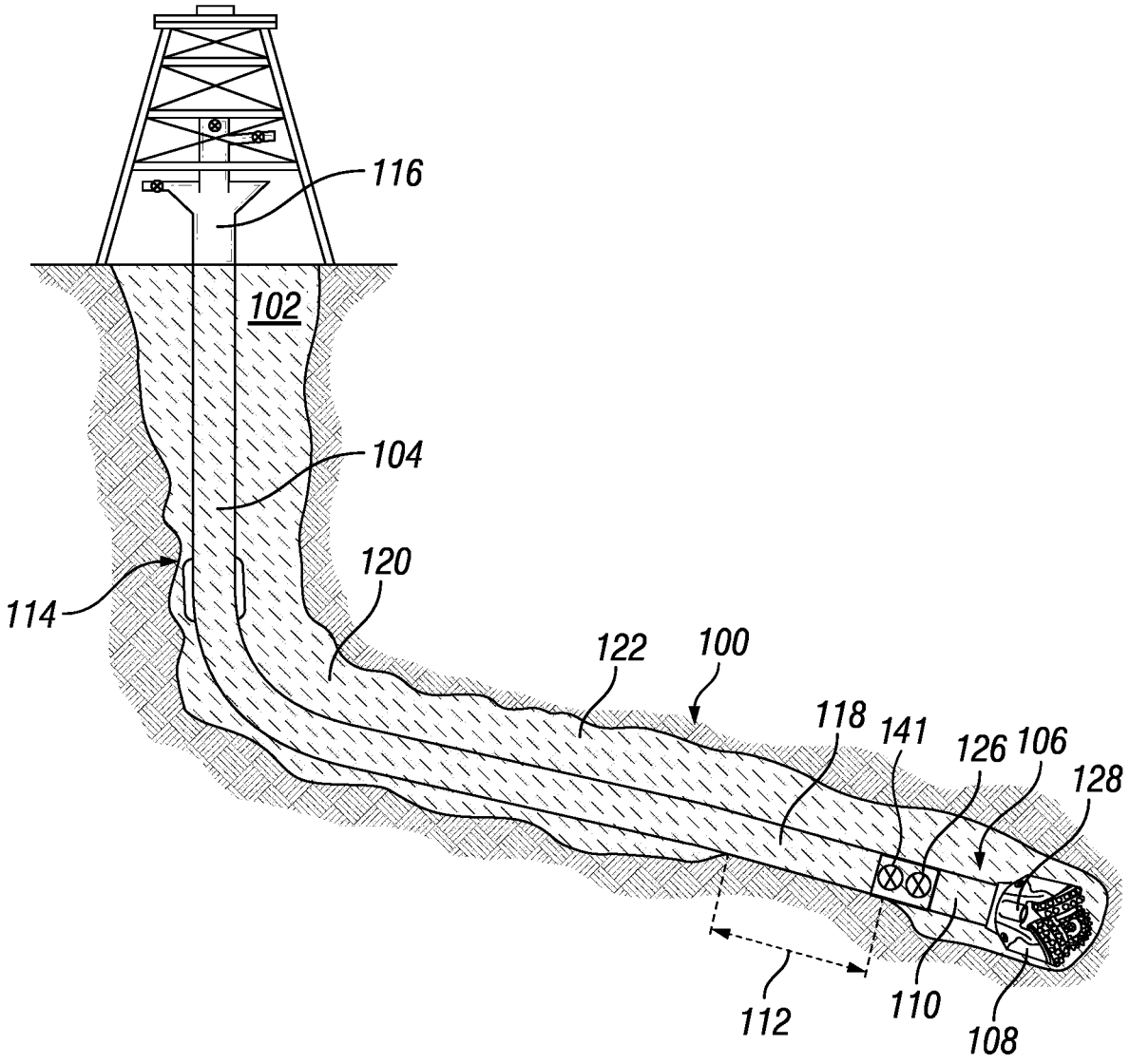
FIG. 1 is a schematic sectional representation of a subterranean well having a system for unsticking a stuck pipe in a subterranean well shown with the tubular string filled with operating fluid, in accordance with an embodiment of this disclosure.

Referring to FIG. 1, subterranean well 100 extends downwards from a surface of the earth, which can be a ground level surface or a subsea surface. Wellbore 102 of subterranean well 100 can be extended generally vertically relative to the surface. Wellbore 102 can alternately include portions that extend generally horizontally or in other directions that deviate from generally vertically from the surface. Subterranean well 100 can be a well associated with hydrocarbon development operations, such as a hydrocarbon production well, an injection well, or a water well.

Tubular string 104 extends into wellbore 102 of subterranean well 100. Tubular string 104 can be, for example, a drill string, a casing string, or another elongated member lowered into subterranean well 100. Wellbore 102 can be an uncased opening. In embodiments where tubular string 104 is an inner tubular member, wellbore 102 can be part of an outer tubular member, such as a casing.

Tubular string 104 can include downhole tools and equipment that are secured in line with joints of tubular string 104. Tubular string 104 can have, for example, bottom hole assembly 106 that can include drilling bit 108 and logging while drilling tools 110. Drilling bit 108 can rotate to create wellbore 102 of subterranean well 100. Logging while drilling tools 110 can be used to measure properties of the formation adjacent to subterranean well 100 as wellbore 102 is being drilled. Logging while drilling tools 110 can also include measurement while drilling tools that can gather data regarding conditions of and within wellbore 102, such as the azimuth and inclination of wellbore 102.

As tubular string 104 moves through wellbore 102, there may be times when tubular string 104 is at risk of becoming stuck or does become stuck, in particular and tubular string 104 is being pulled out of wellbore 102. In embodiments where tubular string 104 is a drill string, the drill string is not generally left in the hole, but is pulled from wellbore 102. The risk of becoming stuck increases, for example, in wellbores 102 with an uneven inner surface or wellbores 102 that have a change in direction. A non-limiting example of a stuck point or stuck section 112 (collectively referred to as "stuck point") is shown in FIG. 1, where tubular string 104 is unable to move both in the axial direction and in the rotational direction. At stuck point 112, tubular string 104 makes contact with the inner surface of wellbore 102. In some embodiments, stuck point 112 is caused by differential sticking.

FIG. 1 also shows a potential obstruction stuck point 114. At obstruction stuck point 114, a shoulder of tubular string 104 will contact a portion of the inner surface of wellbore 102. Contact between the shoulder of tubular string 104 and the inner surface of wellbore 102 will result in friction between the shoulder of tubular string 104 and the inner surface of wellbore 102, will cause a mechanical interference between the shoulder of tubular string 104 and the inner surface of wellbore 102, and will induce a bending moment in tubular string 104.

If tubular string 104 does become stuck, systems and methods of this disclosure can be used to improve the probability of unsticking of freeing tubular string 104. If tubular string 104 becomes a stuck pipe, circulation sub 116 can be secured to an uphole end of tubular string 104 that is outside of subterranean well 100. Circulation sub 116 can manage and direct the flow of two separate fluids simultaneously, one of which can be a liquid and the other which can be a liquid or a gas. Circulation sub 116 can manage the flow of the fluids both in to and out of bore 118 of tubular string 104.

In the embodiment of FIG. 1, operating fluid 120 is located within wellbore 102. Operating fluid 120 is located within annulus 122 defined between an outer surface of tubular string 104 wand an inner surface of wellbore 102 of subterranean well 100. Operating fluid 120 can be, for example, a drilling mud or other fluid used during the development and operation of subterranean well 100.

Figure 2:
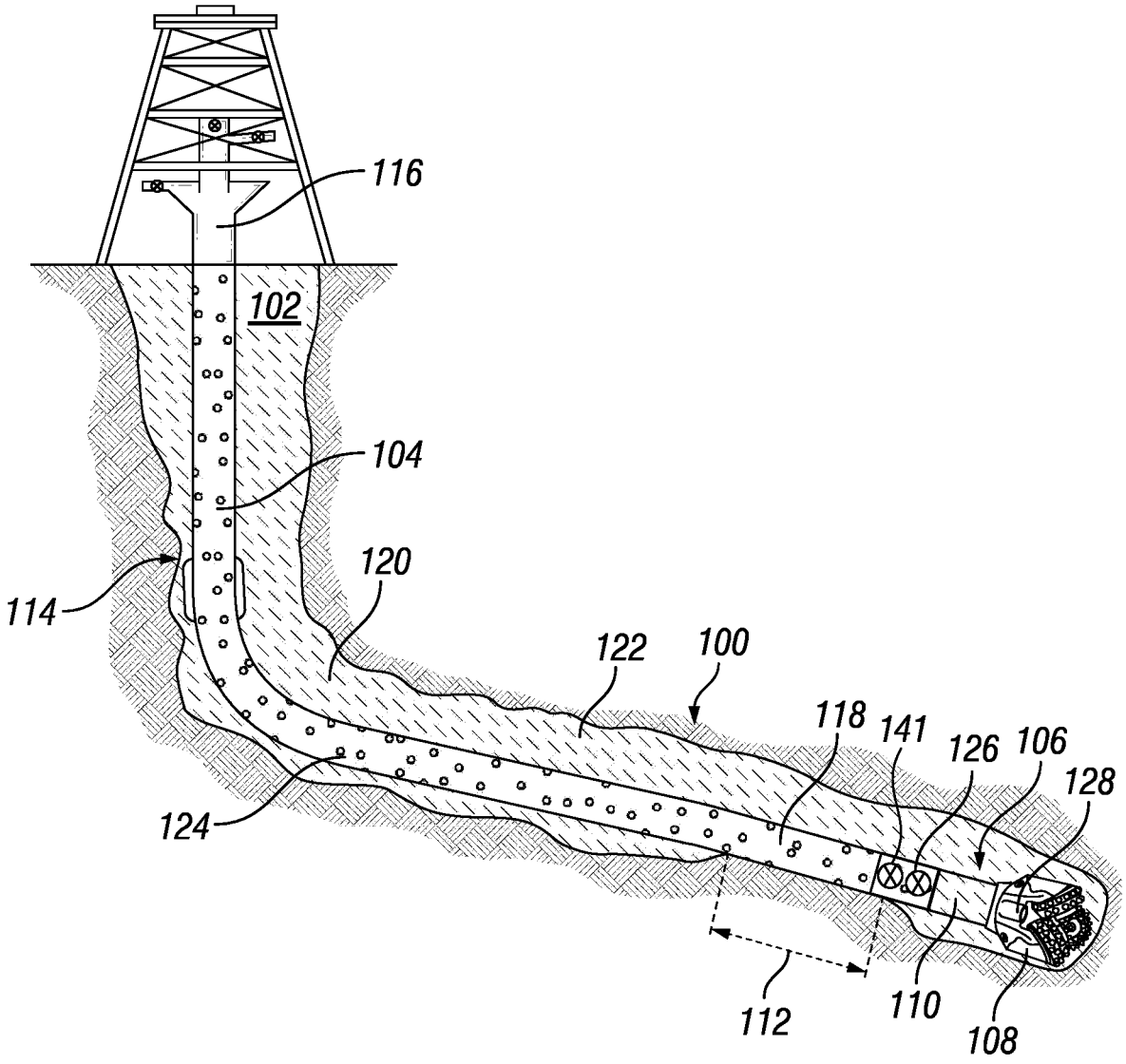
FIG. 2 is a schematic sectional representation of a subterranean well having a system for unsticking a stuck pipe in a subterranean well shown with the tubular string filled with replacement fluid, in accordance with an embodiment of this disclosure.

Looking at FIG. 2, in order to increase the buoyancy of tubular string 104, operating fluid 120 that is located within bore 118 of tubular string 104 can be replaced with replacement fluid 124. The density of replacement fluid 124 is less than the density of operating fluid 120. As an example, operating fluid 120 could be a gas. When using a gas as replacement fluid 124, there would be no significant head or hydrostatic pressure acting on the inside surfaces of the bore of tubular string. Gas, such as a nitrogen gas, would have a significantly lower density than typical operating fluids, such as drilling mud. As an example, the density of drilling mud could be in a range of 62 to 150 pounds per cubic feet while the density of nitrogen gas at 0 degrees Celsius and one atmosphere of pressure (101.325 kPa) is 0.07807 pounds per cubic feet. The density of nitrogen will vary throughout the wellbore. A pressure gauge at the surface, can be used to monitor the depth of nitrogen within bore 118. The pressure limits that correlates to a desired depth can be calculated before the injection of nitrogen using pressure, volume, and temperature formulas.

In alternate embodiments, other gases such as air, carbon dioxide, argon, or natural gas could be used as replacement fluid 124. In other alternate embodiments, a liquid could be used as replacement fluid 124. As an example, water, diesel, oil based mud, and water based mud that have lower density compared to operating fluid could be used as replacement fluid 124. When using a fluid as replacement fluid 124 the change in buoyancy of tubular string 104 when replacing operating fluid 120 with replacement fluid 124 would be less than the change in buoyancy if a gas was used. A benefit to using a liquid as replacement fluid 124 instead of using a gas would be that a liquid could be safer if well control was compromised. Liquids are incompressible and therefore easier to handle with conventional well control equipment such as blowout preventers. If gas is introduced into the well, as gas migrates upwards towards surface, it expands and displaces the operating fluid. Once gas is vented out, the hydrostatic pressure keeping formation fluids in place is greatly reduced and formation fluids might flow to surface, causing a well kick, and could develop into an uncontrolled well blowout.

Replacement fluid 124 can be delivered into bore 118 of tubular string 104 through circulation sub 116. As replacement fluid 124 is delivered into bore 118 of tubular string 104, replacement fluid 124 will cause operating fluid 120 to pass through check valve 126. Check valve 126 can be biased to a closed position and can allow fluids under sufficient pressure to travel in a downhole direction through bore 118 of tubular string 104 past check valve 126. Check valve 126 can prevent fluid from traveling in an uphole direction through bore 118 of tubular string 104 past check valve 126. Check valve 126 can be, for example, a lift check valve, a swing check valve, a ball check valve, a flapper float valve, or a plunger float valve.

After passing through check valve 126, operating fluid 120 can exit bore 118 of tubular string 104 at a location downhole of circulation sub 116 such as through a check valve that allows for one way communication from bore 118 into annulus 122. As an example, operating fluid 120 can exit bore 118 of tubular string 104 at an exit port that is located at a downhole end of tubular string 104. In the example embodiments of FIGS. 1-2, exit port 128 is located at a downhole end of tubular string 104. Exit port 128 provides fluid communication between bore 118 of tubular string 104 and annulus 122. In embodiments where tubular string 104 is a drill string, exit port 128 can be a port through drilling bit 108.

In the example embodiments of FIGS. 1-2, check valve 126 is located adjacent to bottom hole assembly 106. As an example, when tubular string 104 is a drill string formed of a plurality of drill string joints, check valve 126 could be located within the joint of drill string that is adjacent to bottom hole assembly 106. The location of check valve 126 being as close to the downhole end of tubular string 104 as possible would allow for a maximum length of bore 118 of tubular string 104 to be filled with replacement fluid 124, which would result in the maximum increase in buoyancy of tubular string 104. In alternate embodiments, check valve 126 could be part of bottom hole assembly 106.

In other alternate embodiments, check valve 126 could be located at another position along tubular string 104. The location of check valve 126 along tubular string 104 could be selected to result in a desired length of the bore of tubular string 104 to be filled with replacement fluid 124 to obtain the desired increase in buoyancy, or change in stresses and moments acting on tubular string 104 that could be most helpful in unsticking tubular string 104.

After operating fluid 120 exits bore 118 of tubular string 104, an excess amount of operating fluid 120 can be located within annulus 122. This excess portion of operating fluid 120 can travel out of wellbore 102 of subterranean well 100 through annulus 122 and be handled at the surface in a conventional manner for handling circulating operating fluids within a well.

Before and after bore 118 of tubular string 104 is filled with replacement fluid 124, traditional methods and operations for freeing a stuck pipe can be performed. As an example, operations for unsticking tubular string 104 can include jarring or vibrating tubular string 104, spotting grease, acid, or other specialized pill to reduce the friction around tubular string 104, and applying axial and rotational forces to tubular string 104 from the surface.

After completion of the operations for unsticking tubular string 104, whether successful or not, or if the operator otherwise desires to return operating fluid 120 to bore 118 of tubular string 104, replacement fluid 124 can be displaced by operating fluid 120 within bore 118 of tubular string 104. Operating fluid 120 can be delivered into bore 118 of tubular string 104 through circulation sub 116 simultaneously with replacement fluid 124 being removed from or delivered out of bore 118 of tubular string 104. In embodiments where replacement fluid 124 is a gas, replacement fluid 124 can be circulated out of subterranean well 100 through circulation sub 116. In embodiments where replacement fluid 124 is a liquid, replacement fluid 124 can be circulated out of subterranean well 100 through annulus 122 while applying backpressure through a choke manifold to avoid the flow of formation fluids.

Figure 3:
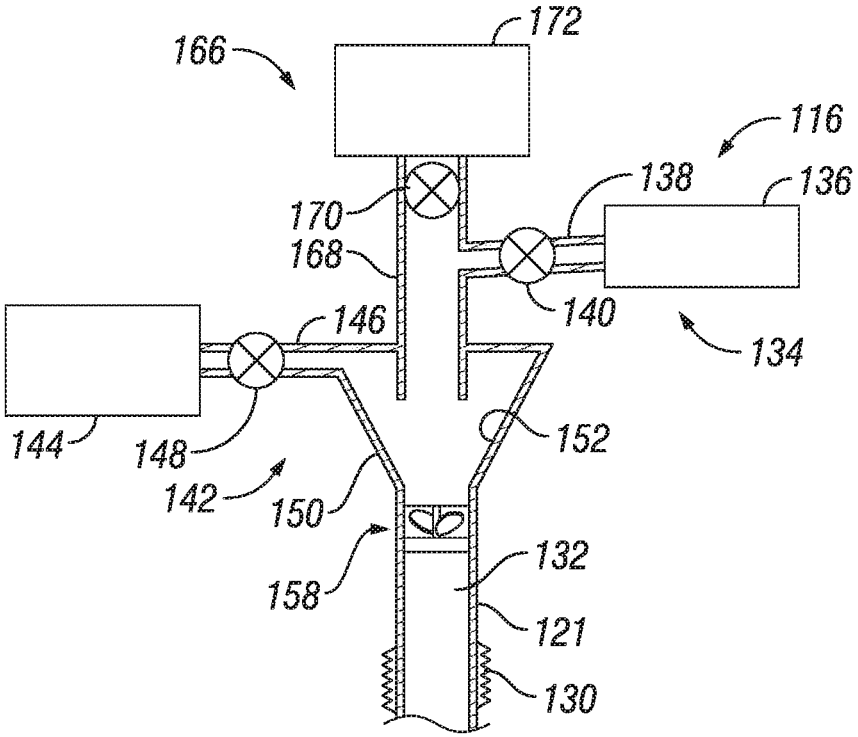
FIG. 3 is a schematic section elevation view of a two-phase circulation sub, in accordance with an embodiment of this disclosure.

Looking at FIG. 3, circulation sub 116 can include multiple fluid flow paths for simultaneous management and control of both operating fluid 120 and replacement fluid 124 that are contained within circulation sub housing 121. Circulation sub housing 121 can be formed of a material that is resistant to hydrogen sulfide corrosion in subterranean wells where hydrogen sulfide is present. Otherwise, circulation sub housing 121 can be formed of conventional materials used to form drill pipe. Circulation sub housing 121 can define the outer shape of circulation sub 116 and define the fluid flow passages within circulation sub 116.

A base of circulation sub 116 can include connection member 130 for securing fastening circulation sub 116 to the uphole end of tubular string 104. Connection member 130 can form a seal connection between circulation sub 116 and tubular string 104. In the embodiment of FIG. 3, connection member 130 is external threads that can mate with threads of tubular string 104 or mate with a collar that is in turn mated with tubular string 104. As an example, a commercially available chemical compound can be applied to the threads of the connection to both seal and lock the threads. Alternately, the threaded connection itself can form a sealed connection. Providing a sealed connection between circulation sub 116 and tubular string 104 can provide an additional layer of safety and well control in case of a failure of check valve 126. The base of circulation sub 116 can include circulation sub bore 132. Circulation sub bore 132 extends axially through circulation sub 116 and is in fluid communication with bore 118 of tubular string 104.

Circulation sub 116 can include replacement fluid delivery assembly 134 for delivering replacement fluid 124 into bore 118 of tubular string 104. Replacement fluid delivery assembly 134 can include a source of compressed replacement fluid 136. The source of compressed replacement fluid 136 can be, for example a storage tank for containing replacement fluid 124 together with a compressor for pressurizing replacement fluid 124. If replacement fluid 124 is air, source of compressed replacement fluid 136 can be an air compressor without a need for a storage tank. In alternate embodiments, source of compressed replacement fluid 136 can be a pressure vessel that contains pressurized replacement fluid 124.

Replacement fluid delivery line 138 extends between circulation sub bore 132 and source of compressed replacement fluid 136. Source valve 140 can be located along replacement fluid delivery line 138 for controlling the flow of fluids between source of compressed replacement fluid 136 and circulation sub bore 132. In order to deliver replacement fluid 124 to bore 118 of tubular string 104 source valve 140 can be moved to an open position and replacement fluid 124 will travel from source of compressed replacement fluid 136, through circulation sub 116 and into bore 118 of tubular string 104.

During the process of delivering replacement fluid 124 into bore 118 of tubular string 104 the surface pressure of replacement fluid 124 can be managed so that a level of replacement fluid 124 within bore 118 of the tubular string 104 is controlled. The injection pressure of replacement fluid 124 can also be managed so that replacement fluid 124 is prevented from passing through check valve 126. In particular, for embodiments where replacement fluid 124 is a gas, replacement fluid 124 may not provide sufficient hydrostatic pressure within annulus 122 to prevent formation fluids from moving towards the surface. The injection pressure of replacement fluid 124 will be sufficient to force operating fluid 120 through check valve 126, but will be less than the pressure required for the replacement fluid 124 to reach and pass through check valve 126. A standpipe pressure gauge can be monitored to ensure that the level of replacement fluid does not extend downhole as far as check valve 126.

In order to increase the certainty that replacement fluid 124 is not released into annulus 122, plug 141 can be inserted into bore 118 of tubular string 104. Plug 141 can also prevent any fluids from traveling uphole past plug 141 if check valve 126 was to fail. Plug 141 can further completely block the flow of any fluids past plug 141 in either direction. Plug 141 could be used, for example as an extra precaution in wells where there is an increased concern regarding well control. In embodiments where plug 141 is inserted into bore 118, coiled tubing or another tubular member with an outer diameter smaller than the diameter of bore 118 can be used to either remove operating fluid 120 or to deliver replacement fluid 124 for displacement of operating fluid 120.

Circulation sub 116 also includes operating fluid delivery assembly 142. Operating fluid delivery assembly 142 includes operating fluid pump 144. In embodiments where operating fluid 120 is drilling mud, operating fluid pump 144 can be a mud pump. Operating fluid delivery line 146 provides fluid communication between circulation sub bore 132 and operating fluid pump 144. Operating valve 148 can be located along operating fluid delivery line 146 for controlling the flow of fluids between operating fluid pump 144 and circulation sub bore 132.

When replacement fluid 124 in bore 118 of tubular string 104 is to be replaced with operating fluid 120, operating fluid 120 can be delivered through circulation sub 116. In order to deliver replacement fluid 124 to bore 118 of tubular string 104 operating valve 148 can be moved to an open position and operating fluid 120 will be pumped by operating fluid pump 144 and will travel through circulation sub 116 and into bore 118 of tubular string 104.

Figure 4:
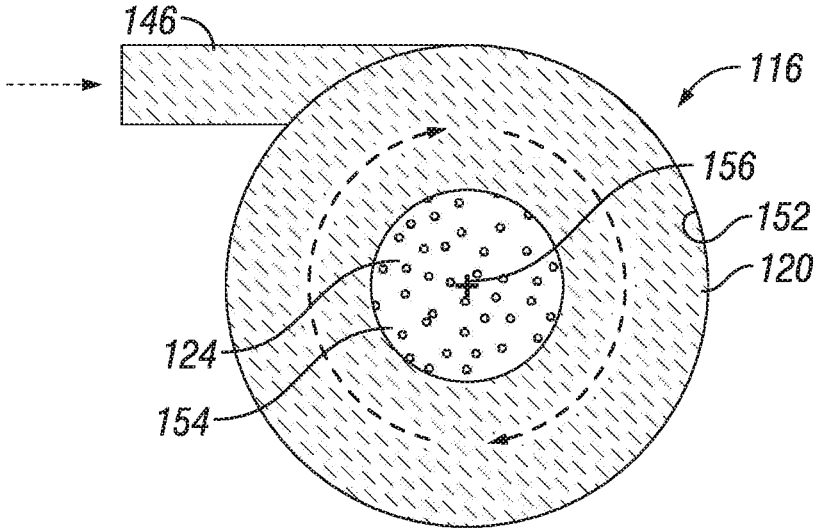
FIG. 4 is a schematic section plan view of a circulation sub, in accordance with an embodiment of this disclosure.

In embodiments where replacement fluid 124 is a gas, circulation sub 116 can be a two-phase circulation sub that is operable to allow for a liquid operating fluid 120 to be delivered in a downhole direction into tubular string 104 while simultaneously venting a gaseous replacement fluid 124 out of tubular string 104. In such embodiments, operating fluid delivery assembly 142 can further include conical bore 150. Conical bore 150 is aligned with circulation sub bore 132 and has frusto conical inner surface 152. Looking at FIGS. 3-4, operating fluid delivery line 146 meets conical bore 150 tangentially so that a centrifugal force is imparted in the operating fluid 120. Operating fluid 120 is therefore delivered to frusto conical inner surface 152 in a manner so that frusto conical inner surface 152 directs operating fluid 120 into bore 118 of tubular string 104 along the inner wall of bore 118 of tubular string 104 in a rotational direction. As operating fluid 120 travels along an inner wall of bore 118 of tubular string 104, operating fluid 120 defines return vent 154 along a central axis 156 of bore 118 of tubular string 104. Return vent 154 is free of operating fluid 120 and can provide a flow path for replacement fluid 124 that is being delivered out of subterranean well 100 and into circulation sub 116.

In embodiments of this disclosure, additional means can be used to create and maintain the rotation of operating fluid 120 within bore 118 of tubular string 104 along the inner wall of bore 118 of tubular string 104. As an example, rotation unit 158 can be used to supplement the rotational path of operating fluid 120 as operating fluid 120 passes through circulation sub 116 and enters bore 118 of tubular string 104. Rotation unit, can include, for example, a motor that rotates a length of circulation sub bore 132, rotating impellers, stationary vanes, and combinations of each of these.

Alternately, circulation sub 116 can allow for rotation of tubular string 104. The rotation of tubular string 104 can not only assist with maintaining the rotating path of operating fluid 120 along the inner wall of bore 118 of tubular string 104, but can be used to assist with the freeing of tubular string 104. Looking at FIG. 5, rotatable circulation sub 116' can essentially function in the same manner as circulation sub 116 of FIG. 3. Rotatable circulation sub 116' further includes first swivel 160 at a first end of rotatable circulation sub 116', second swivel 162 at a second end of rotatable circulation sub 116' that is opposite the first end of rotatable circulation sub 116'. First swivel 160 and second swivel 162 can allow for both or either of rotation of tubular string 104 or axial reciprocation of tubular string 104 within wellbore 102.

Figure 5:
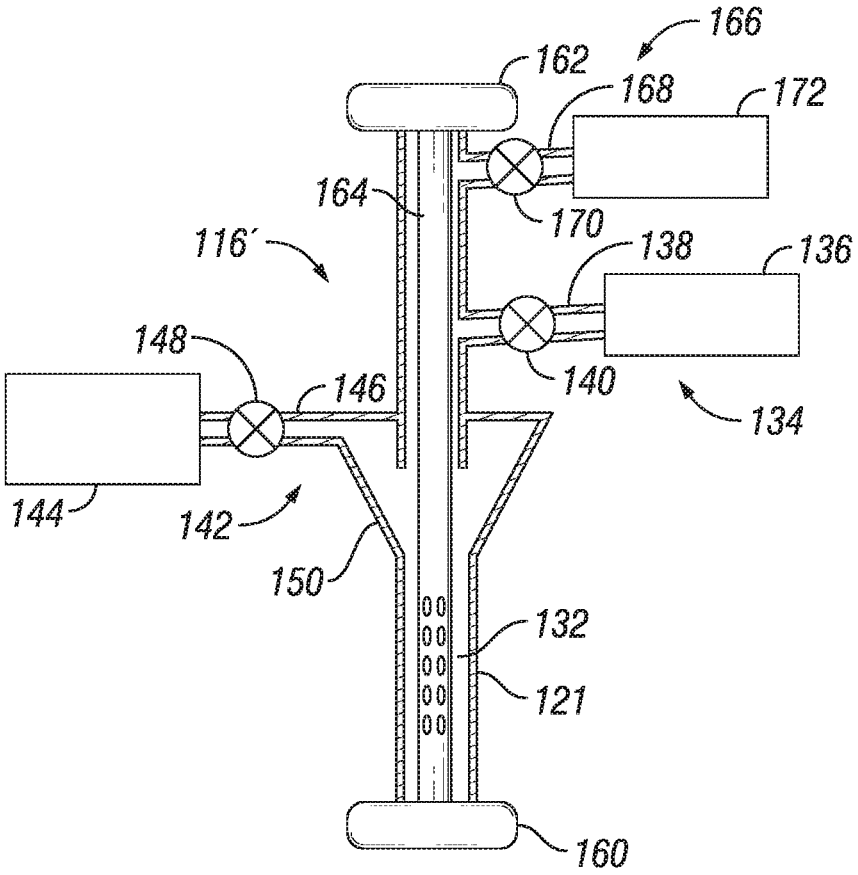
FIG. 5 is a schematic section elevation view of a rotatable circulation sub, in accordance with an embodiment of this disclosure.

Rotatable circulation sub 116' further includes ported tubular member 164 extending between first swivel 160 and the second swivel 162. Ported tubular member 164 extends through circulation sub bore 132. Ported tubular member 164 has a central bore and ports that extend through a sidewall of ported tubular member 164 so that the bore of ported tubular member 164 is in fluid communication with circulation sub bore 132. In the embodiment of FIG. 5, replacement fluid delivery assembly 134 and operating fluid delivery assembly 142 are in fluid communication with bore 118 of tubular string 104 by way of ported tubular member 164. Ported tubular member 164 rotates relative to circulation sub housing 121. Alternately, ported tubular member 164 can axially reciprocate relative to circulation sub housing 121.

An end of ported tubular member 164 can be secured to tubular string 104 so that rotation or reciprocation of ported tubular member 164 results in corresponding rotation or reciprocation of tubular string 104. While performing operations for unsticking tubular string 104, ported tubular member 164 can be rotated or reciprocated so that tubular string 104 rotates or reciprocates, assisting with the freeing of tubular string 104. During the delivery of operating fluids 120 into bore 118 or tubular string 104, ported tubular member 164 can be rotated so that tubular string 104 rotates and help to maintain the rotation of operating fluid 120 within bore 118 of tubular string 104 along the inner wall of bore 118 of tubular string 104.

Looking at FIGS. 3 and 5, circulation sub 116 also includes venting assembly 166. Venting assembly 166 includes venting line 168 that is in fluid communication with return vent 154. As operating fluid 120 is delivered into bore 118 of tubular string 104, replacement fluid 124 is delivered out of subterranean well 100 by way of return vent 154 and through venting assembly 166 of circulation sub 116.

Venting assembly 166 can include vent valve 170 that is located along venting line 168. Vent valve 170 controls the flow of fluids though venting line 168. Venting assembly 166 can include venting exit assembly 172. Venting exit assembly 172 can include a vent tank for containing replacement fluid 124 that is removed from bore 118 of tubular string 104. Venting exit assembly can alternately vent the replacement fluid to the atmosphere, for example, where replacement fluid 124 is air and remains uncontaminated. Venting exit assembly 172 can alternately include a vacuum unit. The vacuum unit can assist in reducing the pressure of the replacement fluid 124 at circulation sub 116, drawing replacement fluid 124 more quickly out of bore 118 of tubular string 104. The reduction in pressure caused by the vacuum unit will, however, increase the pressure differential across check valve 126 so check valve 126 should be appropriately pressure rated to withstand a sufficient pressure differential.

In an example of operation, when tubular string 104 becomes a stuck pipe, in particular as tubular string 104 is being pulled out of wellbore 102, conventional methods of freeing a stuck pipe can be utilized. As an example, the mud weight can be increased to maximum a possible overbalance to minimize the risk of kicks and increase the buoyancy of tubular string 104. As an example, mud with a low solid content is or use heavy brine could be used. If required a heavier mud cap can be added and the filling rate can be increased. Spot grease, acid, or another specialized pill can be used to reduce the friction around tubular string 104. Jarring can alternately be attempted to free tubular string 104.

If these methods are not successful in freeing tubular string 104, the buoyancy of tubular string 104 can be reduced to increase the success of freeing tubular string 104. Circulation sub 116 can be secured to an uphole end of tubular string 104. Operating fluid 120 located within bore 118 of tubular string 104 with replacement fluid 124 by pumping replacement fluid through circulation sub 116 with sufficient pressure for operating fluid 120 to pass through check valve 126 and exit bore 118 of tubular string 104. During the delivery of replacement fluid 124 into bore 118 of tubular string 104, both source valve 140 and operating valve 148 should be in a closed position. The injection pressure of replacement fluid 124 can then be reduced so that no replacement fluid 124 passes through check valve 126. In addition, reducing the injection pressure of replacement fluid 124 will reduce the internal stresses within bore 118 of tubular string 104.

After tubular string 104 is freed and is no longer a stuck pipe, or if it is otherwise desired to return operating fluid 120 to bore 118 of tubular string 104, operating fluid 120 can be delivered into bore 118 of tubular string 104 through circulation sub 116. Operating fluid 120 should be sufficiently thin so that operating fluid 120 does not force replacement fluid 124 in a downhole direction within tubular string 104. Operating fluid 120 is delivered into bore 118 of tubular string 104 along an inner wall of bore 118 along a rotational path. As operating fluid 120 is delivered into bore 118 of tubular string 104, replacement fluid 124 is being delivered out of bore 118 of tubular string 104 through return vent 154.

Replacing operating fluid 120 with replacement fluid 124 within bore 118 of tubular string 104 will create a number of factors that could each improve the probability of freeing tubular string 104. As an example, replacing operating fluid 120 with replacement fluid 124 within bore 118 or tubular string 104 will reduce the buoyancy of tubular string 104. The Archimedean Principle states that the upward buoyant force that is exerted on a body immersed in a fluid, whether fully or partially submerged, is equal to the weight of the fluid that the body displaces and acts in the upward direction at the center of mass of the displaced fluid. For a tubular member that is filled with operating fluid and located within a wellbore filled with operating fluid, such as a mud, the buoyant force is equal to weight of displaced mud by the volume of steel.

$$\text{Buoyant Force} = \text{MW} * \text{Steel Displacement} * g$$

Where MW is mud weight, which can be measured as pounds per cubic feet (lbs/ft^3). Steel Displacement is the volume of the steel that forms the pipe, which can be measured in cubic feet (ft^3). g is the force of gravity, which is a constant with a value of about 32.2 feet per second squared (ft/s^2).

This force is simplified in the drilling industry by using what is called "buoyancy factor", which is derived from the above equation to calculate pipe weight in mud.

When the tubular member is instead empty, or filled with a gas, the volume of mud displaced is equal to volume displaced from inside the string and volume of steel displacement.

$$\text{Buoyant Force} = \text{MW} * (\text{Internal Volume} + \text{Steel Displacement}) * g$$

Where Internal Volume is the volume of the bore of the pipe, which can be measured in cubic feet (ft^3).

As outlined in the example described in Tables 1-2 below, buoyancy increases by displacing inside the string with gas. The example data relates to a drill string consisting of 5.5" drill pipe with mud having a density of 126 pounds per cubic feet and a string length of 10,951 feet. The reduction of hook load is 162,329 lbf which accounts for 80.78% reduction of hook load. This extra margin will definitely increase the chance of freeing the pipe.

TABLE 1

Calculation of Geometry of Tubular String

| Pipe Body | | | Tool Joint | | |
|---|---|---|---|---|---|
| Length | 30 | ft | Length | 1.2886 | ft |
| Pipe OD | 5.5 | in | OD | 6.625 | in |
| Pipe ID | 4.67 | in | ID | 4 | in |
| Weight | 676.77 | lbf | Weight | 96.05 | lbf |
| Volume | 1.38 | ft^3 | Volume | 0.20 | ft^3 |
| Pipe weight | 24.7 | ppf | | | |
| MW | 126 | lb/ft^3 | | | |
| Depth | 10951.01 | ft | | | |
| # of joints | 350 | Joint | | | |

TABLE 2

Calculation of Change in Buoyancy

| | Mud inside & outside string | Mud outside string, gas inside | |
|---|---|---|---|
| Buoyancy Force | 69,554.22 | 231,882.99 | lbf |
| Weight in Air | 270,488.65 | 270,488.65 | lbf |
| Weight in Mud | 200,934.42 | 38,605.65 | lbf |
| Percentage of Wair | 25.71% | 85.73% | |

A buoyancy force acts upwards on the horizontal cross-sectional area. In vertical wells, the buoyancy force is acting at a lowermost point of the string, which would therefore be at or below the stuck point of the string. The change in buoyancy from replacing operating fluid with a replacement fluid will therefore increase the upwards force acting on the stuck point. In deviated or horizontal wells, the buoyant force will tend to lift the string from the low side of the well, which will reduce friction forces on the string.

Another result from replacing operating fluid 120 with replacement fluid 124 within bore 118 or tubular string 104 is that normal or sidewall forces within bore 118 of tubular string 104 are reduced. This reduction if sidewall forces can reduce the outer diameter of tubular string 104, allowing tubular string to be more easily freed from a sticking point.

Yet another result from replacing operating fluid 120 with replacement fluid 124 within bore 118 or tubular string 104 is that the weight of tubular string 104 is reduced. Friction forces are a product of the coefficient of friction and normal forces. The normal force is caused by the weight of the string lying against the walls of the wellbore. Reducing the weight of the string will reduce the normal forces, which will in turn reduce friction forces. Note that for differential sticking, the normal force is the resultant of the differential pressure along with pipe sidewall weight. Differential sticking always occurs at low side. Reducing the weight of the string can be particularly helpful in case of differential sticking.

Decreasing the weight of the string will additionally allow the string to be moved in a desired direction more easily. Therefore by reducing the weight of the string, the use of conventional methods for freeing a stuck pipe can result in an improved response by the string to such methods.

Still another result from replacing operating fluid 120 with replacement fluid 124 within bore 118 or tubular string 104 is increasing pipe flexibility to bending moments due to the internal pressure support being reduced. The factors causing a stuck pipe at an inclined shoulder of a part of the string, such as obstruction stuck point 114 has a frictional component, a mechanical component, and a bending moment component. By reducing the internal pressure support, the string will more easily respond to an induced bending moment, which can assist in moving the inclined shoulder past the obstruction within the wellbore.

Another result from replacing operating fluid 120 with replacement fluid 124 within bore 118 or tubular string 104 is the re-arrangement of potential buckling positions along the string. Because a number of forces acting on the string have changed, buckling schemes also have changed. A change in potential buckling points along the string can be a contributing factor for reducing normal forces at a stuck point. As an example, a change in the center of buoyancy can change the buckling scheme. If a portion of tubular string 104 is buckled it can be pushing with a certain force on the walls of wellbore 102 and causing a differential sticking. A change in the location of the center of buoyancy can unbuckle this portion or cause buckling in opposite direction, which can release the sticking.

Embodiments of the disclosure described, therefore, are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method for unsticking a tubular string in a subterranean well, the method including:

securing a circulation sub to an uphole end of the tubular string outside of the subterranean well;

increasing a buoyancy of the tubular string by delivering a replacement fluid through the circulation sub and into a bore of the tubular string, the replacement fluid displacing an operating fluid located within the bore of the tubular string, where a density of the replacement fluid is less than a density of the operating fluid;

performing operations for unsticking the tubular string;

displacing the replacement fluid in the bore of the tubular string with the operating fluid, and delivering the replacement fluid out of the subterranean well; where the circulation sub is a two-phase circulation sub that includes an operating fluid delivery assembly, the operating fluid delivery assembly including a conical bore with a frustoconical inner surface, and where displacing the replacement fluid in the bore of the tubular string with the operating fluid includes delivering the operating fluid to the frustoconical inner surface so that the frustoconical inner surface directs the operating fluid into the bore of the tubular string along an inner wall of the bore of the tubular string in a rotational direction, the operating fluid defining a return vent along a central axis of the bore of the tubular string, the return vent being free of operating fluid.

2. The method of claim 1, where delivering the replacement fluid through the circulation sub and into the bore of the tubular string causes the operating fluid to pass through a check valve and exit the bore of the tubular string at a location downhole of the circulation sub.

3. The method of claim 2, further including managing an injection pressure of the replacement fluid so that a level of replacement fluid within the bore of the tubular string is controlled and the replacement fluid is prevented from passing through the check valve.

4. The method of claim 1, where the operating fluid exits the tubular string at a downhole end of the tubular string.

5. The method of claim 1, where the operating fluid is a drilling mud and the replacement fluid is a gas.

6. The method of claim 1, where the circulation sub further includes a venting assembly, the venting assembly having a fluid flow path in fluid communication with the return vent, and where the replacement fluid is delivered out of the subterranean well through the circulation sub by venting the replacement fluid through the venting assembly.

7. The method of claim 1, where the circulation sub includes a replacement fluid delivery assembly having a source of compressed replacement fluid, where delivering the replacement fluid through the circulation sub includes delivering the replacement fluid from the source of compressed replacement fluid.

8. The method of claim 1, further including locating a plug within the bore of the tubular string downhole of the circulation sub, the plug preventing a flow of fluid through the bore of the tubular string past the plug.

9. The method of claim 1, where the circulation sub includes a first swivel at a first end of the circulation sub, a second swivel at a second end of the circulation sub, and a ported tubular member extending between the first swivel and the second swivel, where performing operations for unsticking the tubular string includes rotating the tubular string.

10. A method for unsticking a tubular string in a subterranean well, the method including:

securing a circulation sub to an uphole end of the tubular string outside of the subterranean well;

increasing a buoyancy of the tubular string; where a replacement fluid is delivered through the circulation sub and into a bore of the tubular string;

the replacement fluid displaces an operating fluid located within the bore of the tubular string so that the operating fluid passes through a check valve and exits the bore of the tubular string at a location downhole of the circulation sub;

a portion of the operating fluid travels out of the subterranean well through an annulus defined between an outer surface of the tubular string and an inner surface of a wellbore of the subterranean well; and a density of the replacement fluid is less than a density of the operating fluid;

performing operations for unsticking the tubular string;

displacing the replacement fluid in the bore of the tubular string with the operating fluid; where the operating fluid is delivered through the circulation sub and into the bore of the tubular string as a rotational flow along an inner wall of the bore of the tubular string the operating fluid defining a return vent along a central axis of the bore of the tubular string, the return vent being free of operating fluid; and the replacement fluid is delivered out of the subterranean well through the return vent and the circulation sub.

11. The method of claim 10, further including managing an injection pressure of the replacement fluid so that the replacement fluid is prevented from passing through the check valve.

12. The method of claim 10, where the circulation sub includes an operating fluid delivery assembly, the operating fluid delivery assembly causing the rotational flow of the operating fluid with a system selected from a group consisting of a conical bore with a frustoconical inner surface, a motor that rotates a portion of the circulation sub, rotating impellers, stationary vanes, and combinations thereof.

13. The method of claim 10, where the circulation sub includes a first swivel at a first end of the circulation sub, a second swivel at a second end of the circulation sub, and a ported tubular member extending between the first swivel and the second swivel, where performing operations for unsticking the tubular string includes rotating the tubular string.

14. A system for unsticking a tubular string in a subterranean well, the system including:

a circulation sub secured to an uphole end of the tubular string outside of the subterranean well;

a check valve located within a bore of the tubular string downhole of circulation sub;

an annulus defined between an outer surface of the tubular string and an inner surface of a wellbore of the subterranean well; where the circulation sub is operable to deliver a replacement fluid into the bore of the tubular string so that an operating fluid exits the bore of the tubular string through the check valve;

the circulation sub is further operable to deliver operating fluid into the bore of the tubular string as the replacement fluid is delivered out of the subterranean well; and a density of the replacement fluid is less than a density of the operating fluid; where the circulation sub includes an operating fluid delivery assembly, the operating fluid delivery assembly including a conical bore with a frustoconical inner surface shaped to direct the operating fluid into the bore of the tubular string along an inner wall of the bore of the tubular string so that the operating fluid is delivered into the bore of the tubular string as a rotational flow along the inner wall of the bore of the tubular string, the operating fluid defining a return vent along a central axis of the bore of the tubular string, the return vent being free of operating fluid so that the replacement fluid is delivered out of the subterranean well through the return vent and the circulation sub.

15. The system of claim 14, further including an exit port located at a downhole end of the tubular string, the exit port providing fluid communication between the bore of the tubular string and the annulus.

16. The system of claim 14, where the operating fluid is a drilling mud and the replacement fluid is a gas.

17. The system of claim 14, where the circulation sub further includes a venting assembly, the venting assembly having a fluid flow path in fluid communication with the return vent.

18. The system of claim 14, where the circulation sub includes a replacement fluid delivery assembly having a source of compressed replacement fluid.

19. The system of claim 14, where the circulation sub includes a first swivel at a first end of the circulation sub, a second swivel at a second end of the circulation sub, and a ported tubular member extending between the first swivel and the second swivel.

* * * * *